United States Patent [19]

Geilinger et al.

[11] Patent Number: 4,914,718

[45] Date of Patent: Apr. 3, 1990

[54] SYSTEM FOR COVERING THE ENERGY REQUIRED FOR LIGHTING AND HEATING A BUILDING

[75] Inventors: Peter Geilinger, Winterthur; Bruno Keller, Zurich, both of Switzerland

[73] Assignee: Geilinger AG, Winterthur, Switzerland

[21] Appl. No.: 178,855

[22] Filed: Mar. 31, 1988

Related U.S. Application Data

[63] Continuation of Ser. No. 878,985, filed as PCT CH85/00142 on Oct. 1, 1985, published as WO86/02144 on Apr. 10, 1986, abandoned.

[30] Foreign Application Priority Data

Oct. 8, 1984 [EP] European Pat. Off. ..... 84810485

[51] Int. Cl.[4] ..... H05B 3/44

[52] U.S. Cl. ..... 219/213; 219/220; 219/361

[58] Field of Search ..... 219/213, 220, 354, 347, 219/358, 361, 473, 345

[56] References Cited

U.S. PATENT DOCUMENTS

| | | | |
|---|---|---|---|
| 2,700,095 | 1/1955 | Needham | 219/220 |
| 3,025,379 | 3/1962 | Ford | 219/220 |
| 3,141,086 | 7/1964 | Prager | 219/220 |
| 3,546,427 | 12/1970 | Farrell | 219/220 |
| 3,567,353 | 3/1971 | Eisler | 219/358 |
| 3,909,589 | 9/1975 | Stone | 219/361 |
| 3,958,100 | 5/1976 | Stone | 219/361 |

FOREIGN PATENT DOCUMENTS

| | | | |
|---|---|---|---|
| 0117885 | 9/1984 | European Pat. Off. . | |
| 2548775 | 5/1977 | Fed. Rep. of Germany . | |
| 2940830 | 4/1981 | Fed. Rep. of Germany . | |
| 717620 | 1/1932 | France | 219/220 |

OTHER PUBLICATIONS

Panelectric brochure, National Gypsum Co., Feb. 1968.
Raxcon brochure, The Rayboard Co., Mar. 1968.
"Heating/Exhaust Scheme", Electrical Construction and Maint., Mar. 1970, vol. 69, No. 3, p. 90.
"Sparsame Bürobauten", Sonderteil Energie 82, vol. 88, Apr. 1982, No. 2, p. 54, Gräfeling, W. Germany.
"Wärmeruckgewinnung . . . ", Gilli, P. G., Bauphysik, vol. 4, Dec. 1982, No. 6, pp. 203-208, Berlin, W. Germany.

*Primary Examiner*—Teresa J. Walberg
*Attorney, Agent, or Firm*—Kenyon & Kenyon

[57] ABSTRACT

For reducing the energy required for lighting and heating in a room (2) of a building (1), windows (4) and opaque wall parts (3) of the outside wall are designed so that their heat transfer numbers ($k_F$ and $k_W$, respectively) are smaller than 1 $W/m^2K$. Electric lighting fixtures (7) and heaters (8) which have at least approximately equal power ratings are used for lighting and heating.

11 Claims, 1 Drawing Sheet

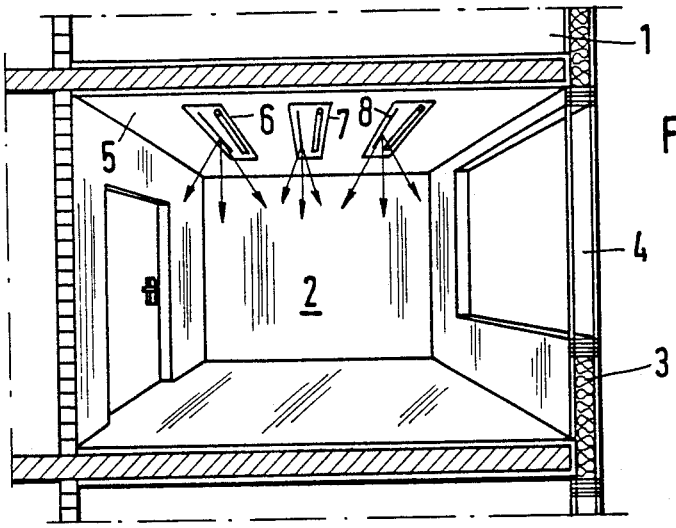
Fig.1
Fig. 2
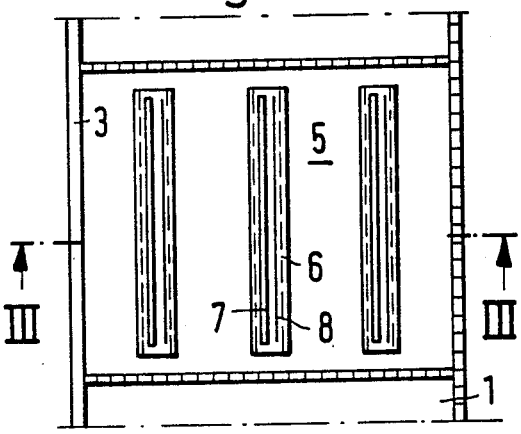
Fig. 3
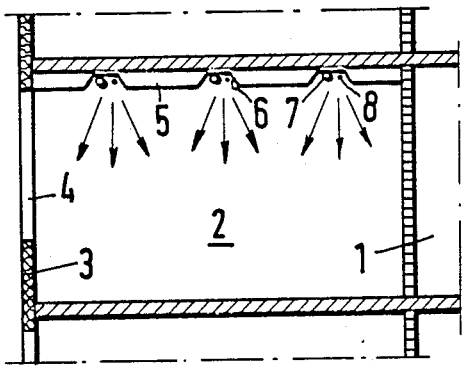
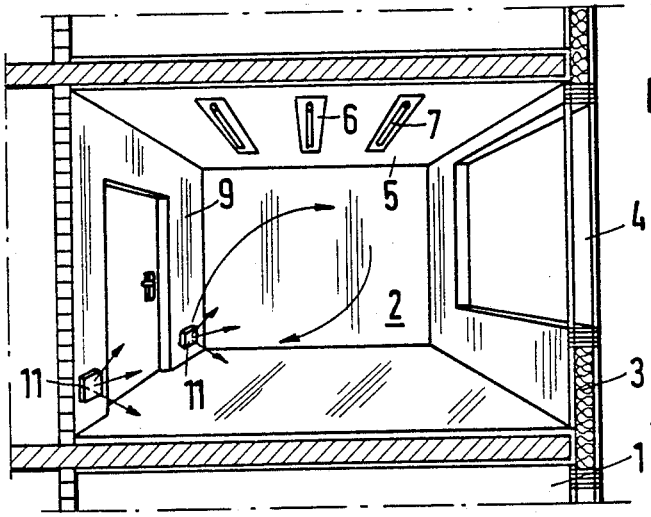
Fig.4

SYSTEM FOR COVERING THE ENERGY REQUIRED FOR LIGHTING AND HEATING A BUILDING

This application is a continuation of application Ser. No. 878,985, filed as PCT CH85/00142 as Oct. 1, 1985, published as WO86/02144 as Apr. 10, 1986, now abandoned.

The invention relates to a system for covering the energy required for lighting and heating a building, the rooms of which can be heated and are subjected to artificial light as well as to daylight via windows.

The outside walls of buildings consist generally in part of transparent structural parts, for instance, windows, and in part of opaque wall parts such as facade panels or masonry and the like. These, parts exhibit considerable differences as to their heat retardation capacity: for conventional windows, the heat transfer numbers (k-values) are up to 6- times (1.0 to 2.8 $W/m^2.K$) those for opaque wall parts (0.3 to 0.5 $W/m^2.K$). Consequently, glass surfaces have a lower surface temperature on cold days than the other parts of the outside wall. This leads to a cold-air drop in front of the window and to drafts as well as a unilateral radiation deficit for the occupants of the room. In order to assure the desired comfort for them, heating systems such as radiators, convectors, additional floor heaters, etc. are arranged under the windows in roder to compensate, by the warm-air curtain generated thereby, the effect of the cold window surface.

However, several grave disadvantages are connected with these measures and arrangements:

extensive and complicated installations are required with heating lines which must be brought up to the periphery of the building, the utilization of space- in the vicinity of the windows is greatly limited due to the arrangement of heating installations, the temperature difference and the heat transfer at the window are increased by the warm-air curtain, which leads to increased energy losses at the window.

Also the other functions of the windows, namely, the supply of daylight and connections to the outside world, are unfavorable energy-wise in conventional construction systems. For such buildings, there is presently only the choice between equipping the building with windows all the way with consequent high energy consumption by means of large heating systems or a greatly reduced window area on the North, East and West sides of the building with unfavorable consequences as to the freedom of architectural design, as well as considerable limitations with respect to daylight and increased energy requirements for artificial lighting.

It is therefore an object of the invention to provide an improved and energy-efficient system for a building.

It is another object of the invention to reduce the energy required and the demands regarding the peak power necessary for a residental dwelling.

It is another object of the invention to decrease and simplify the wiring required for a residental dwelling.

It is another object of the invention to provide an energy efficient system for heating and lighting a building which assures great comfort.

It is another object of the invention to optimize the energy requirements of a building using daylight.

It is another object of the invention to permit architectual freedom in the design of the window zomes of a building.

Briefly, the invention provides a building having rooms with outside walls, each of which includes a window and an opague wall part wherein the heat transfer number i.e. heat transfer rate (overall k-value) of the entire window and the heat transfer number of the opaque wall parts of the outside walls of the building each have at most a value of 1 $W/m^2.K$;. Further, electric lighting fixtures and electric heating fixtures with comparable ratings are provided for covering the artificial light and heating requirements.

The heat transfer number of the entire window, namely, the overall k-value is composed of the two individual k-value, for the glas panels and for the frame; it can be determined here experimentally either overall or can be calculated as an arithmetic average from the individual k-values, where the latter enter into the calculation proportionally corresponding to the area shares of the glass panels and frames.

"Comparable ratings" is understood here to mean that the installed heating power is between 50 and 150% of the installed lighting power, i.e., the power consumed by the lighting fixtures.

The low k-values for the window can be achieved, for instance, via multiple window panes exceeding double window panes or by measures which are described in European Patent EP-A-117 885; a further possibility is the use of highly heat-insulating and at the same time highly transparent materials such as aerogelene. Maintaining the k-values for the wall parts is accomplished by means of known heat retardation measures and/or materials.

Due to the special design of the outside wall with respect to thermal performance, heating installations in front or under the window for intercepting the cold-air drop can be omitted. In addition, the closely spaced k-values of the window and the wall cause a surface temperature which is largely the same over the entire outside wall surface, so that drafts are avoided. In addition, the average room temperature can be lowered without loss of comfort. The amount of energy for heating, especially if the room is occupied by persons, is so low because of the small heat losses that it can be covered by the artificial lighting or, if no artificial lighting is required, by electric heaters of about the same rating. Advantageously, the lighting and heating fixtures can therefore be arranged together in reflectors equipped with combined sockets, preferably at the ceiling.

If in special cases, heat insulating measures are necessary at the ceiling, the floor or inside walls, the k-values of these elements are, of course, adapted to those of the outside walls.

Since the maximum power that a customer can take out of the power network is frequently limited by the utilities, so that it may, for instance, not be sufficient for electric heating of the conventional kind, it is advantageous, in a further embodiment of the present invention, if the maximum power rating of the installed heaters does not exceed that of the installed lighting fixtures. In addition, the measure may be taken that the turning-on of the lighting and the heating fixtures is controlled so that the respective emitted total power of the two is limited to the value of the installed lighting power.

The invention will be explained in greater detail in the following with the aid of embodiment examples in conjunction with the drawing.

FIG. 1 shows schematically in a 3-dimensional sketch a room designed in accordance with the invention, in a building;

FIG. 2 is a top view of this room as seen against the ceiling,

FIG. 3 illustrates a view taken on line III-III of FIG. 2; and

FIG. 4 illustrates a view similar to FIG. 1 having a modified array of heaters in accordance with the i nvention.

As a section of a larger building 1, FIG. 1 shows a room 2 which is surrounded on three sides by similar rooms which are not shown in detail. On one side, which is arranged to the right in FIG. 1 and to the left in FIGS. 2 and 3, the room 2 is closed off by an outside wall 3, in which a window 4 is provided.

In the ceiling 5 of the room 2, there are radiation reflectors 6 which are arranged at spacings from each other and in each of which a fluorescent tube is installed as a lighting fixture 7 and a commercially available heating rod, for instance, of ceramic as a heater 8. Every reflector 6 and every radiator 7 or 8 therein can be switched on and off by hand, individually and separately.

The lighting fixture 7 and the heater 8 are chosen so that the power consumed by them is the same. It is, for instance, 25 W/m$^2$ of room surface. The power consumption in the individual reflector 6 may be equal or also different.

Furthermore, the lighting and heating fixtures 7 and 8 of the reflector 6 are coupled to each other, in the simplest case via a double-throw switch (not-shown) that can be operated by hand, in their electric circuit in such a way that only the one or the other of the two energy-emitting radiators 7 or 8 can be in operation selectably in a reflector 6.

CALCULATION EXAMPLE

The room 2, which is 3 meters (m) high, has the dimensions 5×4 m$^2$; the area of the window 4 which extends over its entire width and is 2 meters (m) high, is 8 m$^2$. It has double window panes and its k-value is lowered to about 0.7 W/m$^2$.K through installation of transparent coated plastic foils between the panes while that of the opaque parts of the outside wall 3 is 0.5 W/m$^2$.K.

From this are obtained a volume V of 60 m$^3$ for the room 2 and an outside wall area of 12 m$^2$, of which, as mentioned, 8 m$^2$ are window area and 4 m$^2$ opaque window railing.

Assuming an air change of 0.3 per hour, energy losses for the air changes of 6 W/K result therefrom for the air changes as well as for the heat transfer to the outside through the window of 5.6 W/K and through the railing of 2 W/K which results in a total energy loss of 13.6 W/K.

The power required for covering this energy demand is 408 W for an outside temperature of −10° C. (customary design temperature) and a required room temperature of 20° C. The installed lighting and heating power of 500 W is therefore sufficient even if there is no additional heat supply by room occupants, which represents an additional "heating" of 80 W per person.

For sufficient heating of the room 2, the following possibilities are therefore obtained:

in the case of occupancy, only part of the lighting or heating fixtures 7 or 8, i.e., only one or individual onces of the reflectors 6 are switched-on taking into consideration the heat given off by occupants, depending on the illumination by daylight.

during brief periods of non-occupancy, in office buildings, for instance, at night or during weekends, the building 1 and the customary construction material cools down so little (1 to 2° C. temperature drop), that heating during the mentioned non-occupancy times can be eliminated. If required, the heaters 8 or part thereof can be switched on.

during longer breaks in occupancy, heating takes place by the heaters 8 from time to time, depending on the cooling-off of the room 2; for this purpose, the heaters 8 are switched on at time intervals, for instance, periodically by a timer or by a room thermostat as a function of the temperature drop.

The embodiment example according to FIG. 4 differs from that according to FIGS. 1 to 3 only by the fact that the reflector 6 contains only lighting elements 7, while likewise electrically heated surface radiators 11 are provided as heaters at the inside wall 9 of the room 2.

The latter can again be coupled to the lighting fixtures 7 circuit-wise in such a manner that selectably only one lighting fixture 7 or a surface radiator 11 "associated" with it can be in operation. However, it is also possible, of course, to utilize the heaters or surface radiators 11, the heat output of which may be variable continuously or in steps, as an energy source completely or only with their lower output stages, in addition to the artificial light or daylight.

The invention is not limited to the embodiment examples discussed; in particular, the heaters can also be designed as heat exchangers preheating the air to be supplied to the room instead of heat sources radiating directly into the room.

We claim:

1. The combination of a building having at least one room with an outside wall including a window having a heat transfer rate of at most 1 W/m$^2$.K and an opaque wall part having a heat transfer rate of at most 1 W/m$^2$.K;

a plurality of electric lighting fixtures of predetermined power range in said room for providing artificial light; and a plurality of electric heaters in said room for providing heat, said heaters having a power rating of from 50% to 150% of said lighting fixtures, each said heater being coupled with a respective lighting fixture for selective operation of said lighting fixture or said heater.

2. The combination as set forth in claim 1 which further includes a plurality of radiation reflectors in a ceiling of said room, each reflector having one of said lighting fixtures and one of said heaters therein.

3. The combination as set forth in claim 1 wherein said lighting fixture and said heaters have a total power consumption of 25 W/m$^2$ of room surface.

4. The combination as set forth in claim 1 wherein said window has a heat transfer rate of 0.7W/m$^2$K and said opaque wall part has a heat transfer rate of 0.5 W/m$^2$K.

5. The combination of a building having at least one room with an outside wall including a window having a heat transfer rate of at most 1 W/m$^2$K and an opaque wall part having a heat transfer rate of at most 1 W/m$^2$K;

a plurality of electric lighting fixtures in said room for providing artificial light, each said fixture having a predetermined power rating; and a plurality of electric heaters in said room for providing heat, said heaters having power rating of from 50% to 150% of said fixtures with the total power rating of said lighting fixtures and said heaters being equal to $25W/m^2$ of room surface

6. The combination as set forth in claim 5 wherein the maximum power rating of said heaters does not exceed the maximum power rating of said lighting fixtures.

7. The combination as set forth in claim 5 which further comprises means for controlling the turn-on of said lighting fixtures and said heaters whereby the emitted total power of said turned-on fixtures and heaters is limited to the value of the installed lighting power.

8. The combination as set forth in claim 5 wherein said total power rating is 500W.

9. The combination of a building having at least one room with an outside wall including a window having a heat transfer rate of at most $1\ W/m^2K$ and an opaque wall part having a heat transfer rate of at most $1\ W/m^2K$;

a plurality of electric lighting fixtures in said room for providing artificial light, each said lighting fixture having a predetermined power rating; and a plurality of electric heaters in said room for providing heat, each said heater being coupled with and having the same rating of a respective lighting fixture.

10. The combination as set forth in claim 9 which further comprises means for controlling the turning-on of said lighting fixtures and said heaters whereby the power thereof is limited to said power rating of said lighting fixtures.

11. The combination as set forth in claim 9 wherein the total power rating of said lighting fixtures and said heaters is 25W per square meter of room surface.

* * * * *

UNITED STATES PATENT AND TRADEMARK OFFICE

CERTIFICATE OF CORRECTION

PATENT NO. : 4,914,718

DATED : April 3, 1990

INVENTOR(S) : PETER GEILINGER

It is certified that error appears in the above-identified patent and that said Letters Patent is hereby corrected as shown below:

Column 1, line 27 "roder" should be -order-
Column 1, line 67 "zomes" should be -zones- Column 2, line 13 "k-value," should be -k-values- Signed and Sealed this Third Day of September, 1991

*Attest:*

HARRY F. MANBECK, JR.

*Attesting Officer*

*Commissioner of Patents and Trademarks*